US005522151A

United States Patent [19]

Deshpande et al.

[11] Patent Number: 5,522,151

[45] Date of Patent: Jun. 4, 1996

[54] SINGLE TIER DRYER SECTION WITH DUAL REVERSING ROLLS

[75] Inventors: Rajendra D. Deshpande, Rockton; Jeffrey H. Pulkowski, Roscoe, both of Ill.

[73] Assignee: Beloit Technologies, Inc., Wilmington, Del.

[21] Appl. No.: 379,386

[22] Filed: Jan. 27, 1995

[51] Int. Cl.[6] ..... F26B 11/02

[52] U.S. Cl. ..... 34/114; 34/115

[58] Field of Search ..... 34/114, 115, 452, 34/453, 458

[56] References Cited

U.S. PATENT DOCUMENTS

| | | | |
|---|---|---|---|
| 3,417,925 | 12/1968 | Krikorian | 34/114 |
| 3,733,711 | 5/1973 | Haythoenthwaite | 34/114 |
| 3,874,997 | 4/1975 | Kankaanpaa | 34/115 |
| 4,743,419 | 5/1988 | Biersxhenk | 34/115 |
| 4,744,156 | 5/1988 | Futcher | 34/114 |
| 5,084,985 | 2/1992 | Ventola | 34/115 |
| 5,269,075 | 12/1993 | Brunnmair et al. | 34/114 |

*Primary Examiner*—John T. Kwon

*Attorney, Agent, or Firm*—Dirk J. Veneman; Raymond W. Campbell; David J. Archer

[57] ABSTRACT

A paper drying section utilizes two reversing rolls between each dryer roll to extend the available time for vapor to flash from the web. A vacuum box is disposed between the two reversing rolls to support and dry the felt and paper web as it passes from one reversing roll to another. An air cap is used to blow high velocity air onto the exposed surface of the paper web which is held by the vacuum box. The spacing of the two reversing rolls increases the wrap of the single tier dryer by approximately twenty percent over that of a conventional single tier dryer with a single reversing roll. Another configuration dryer section positions the first of the two reversing rolls downwardly beneath its adjacent dryer roll creating a long draw between the dryer roll and the first reversing roll. This long draw is supported by a vacuum box adjacent the felt. The downward positioning of the first roll increases the length of the draw between the first and second reversing rolls, providing additional area for drying by an air cap.

21 Claims, 1 Drawing Sheet

SINGLE TIER DRYER SECTION WITH DUAL REVERSING ROLLS

FIELD OF THE INVENTION

This invention relates to dryers used in papermaking in general. More particularly, this invention relates to dryers of the single tier type.

BACKGROUND OF THE INVENTION

Paper is made by forming a mat of fibers, normally wood fibers, on a moving wire screen. The fibers are in a dilution with water constituting more than ninety-nine percent of the mix. As the paper web leaves the forming screen, it may be still over eighty percent water. The paper web travels from the forming or wet end of the papermaking machine and enters a pressing section where, with the web supported on a felt, the moisture content of the paper is reduced by pressing the web to a fiber content of between forty-two and forty-five percent. After the pressing section, the paper web is dried on a large number of steam heated dryer rolls, so the moisture content of the paper is reduced to about five percent.

The dryer section makes up a considerable part of the length of a papermaking machine. The web as it travels from the forming end to the take-up roll may extend a quarter of a mile in length. A major fraction of this length is taken up in the dryer section. As the paper industry has moved to higher web speeds, upwards of four- to five-thousand feet per minute, the dryer section has had to become proportionately longer because less drying is accomplished at each dryer as the paper moves more quickly through the dryers.

One type of dryer, known as a two-tier dryer, has two rows of steam heated dryer rolls four to seven feet in diameter. The dryer rolls in the upper and lower rows are staggered. The paper web runs in a meandering fashion from an upper dryer roll to a lower dryer roll and then on to an upper roll over as many rolls as is required. An upper felt backs the web as it travels over the upper dryer rolls, and leaves the paper web as it travels to the lower rolls. The upper felt is turned by felt reversing rolls spaced between the upper rolls. On the lower dryer rolls the web is supported by a lower felt, which is also turned between lower dryer rolls by lower felt reversing rolls. This apparatus advantageously dries first one side and then the other of the web, however, the paper web is unsupported for a length as it passes from the upper dryer rolls to the lower dryer rolls, and from the lower rolls to the upper rolls. Unsupported paper webs, present a problem as web speed increases. At higher web speeds, the paper interacts with the air and can begin to flutter. This fluttering can wrinkle and crease the paper web, seriously damaging the quality of the paper produced. Further, the fluttering can lead to tears and web failure, with all the cost and downtime associated with paper lost during the rethreading operation.

A first approach to overcoming this problem was to use a single felt or a wire which traveled with the paper web over both the upper and lower dryers so that the paper was supported through the open draws. This approach limited paper flutter in the open draws, but, because the blanket was disposed between the paper web to be dried and the lower dryer rolls, the effectiveness of the lower dryer rolls was substantially diminished.

A further dryer development is the apparatus manufactured by Beloit Corporation of Beloit, Wis. and sold under the trade name "Bel-Champ." The Bel-Champ dryer has a single tier of dryer upper rolls with vacuum reversing rolls disposed therebetween. The vacuum rolls, such as shown in U.S. Pat. No. 4,882,854 (Wedel, et al.), use vacuum to clamp the edges of the paper to the reversing roll to prevent edge flutter, and use central grooves to allow passage of the trapped boundary layer between the blanket and the reversing rolls. Although the Bel-Champ dyer has proven highly satisfactory in the high-speed production of paper, it would be desirable to increase the rate of drying so as to allow a shorter, less costly dryer section.

One method of shortening the Bel-Champ single tier configuration would be to place air-caps over the vacuum rolls. By blowing high velocity hot air on the paper as it passes around the vacuum roll, drying rates are enhanced and dryer section length is decreased. However, somewhat limited surface area is available. This limits the potential of air-caps for shortening the length of a Bel-Champ dryer section.

What is needed is a dryer section with short open draws, with greater drying capability per unit length of dryer section.

SUMMARY OF THE INVENTION

The paper drying section of this invention modifies the Bel-Champ dryer geometry by utilizing two rolls between each dryer roll to extend the available time for vapor to flash from the web. A vacuum box may be disposed between the two reversing rolls to support and dry the felt and paper web as it passes from one reversing roll to another. This vacuum supported draw between the two reversing rolls allows the positioning of an extended air cap which blows high velocity, two-hundred mile per hour air, heated to five hundred degrees, onto the exposed surface of the paper web, which in turn is supported on the felt which is held rigidly by the vacuum box. The utilization of two reversing rolls spaced apart increases the wrap of the single tier dryer by approximately twenty percent over that of a conventional single tier dryer with a single reversing roll.

Another configuration of the dryer section of this invention moves the first of the two reversing rolls downwardly beneath its adjacent dryer creating a long draw between the adjacent dryer and the first reversing roll. This long draw is supported by a vacuum box. The downward positioning of the first roll increases the length of the draw between the first and second reversing rolls, providing additional area for drying by an air cap with heated, high velocity air.

It is an object of the present invention to provide a dryer for a papermaking machine of shorter length.

It is another object of the present invention to provide a dryer section for a papermaking machine which can operate at higher velocities.

It is yet another object of the present invention to provide a dryer section for a papermaking machine which can effectively utilize hot air caps.

It is yet another advantage of the present invention to provide a dryer section which wraps paper web over a greater percentage of the dryer surfaces.

Further objects, features, and advantages of the invention will be apparent from the following detailed description when taken in conjunction with the accompanying drawings.

DESCRIPTION OF THE PREFERRED EMBODIMENT

Figure 1:
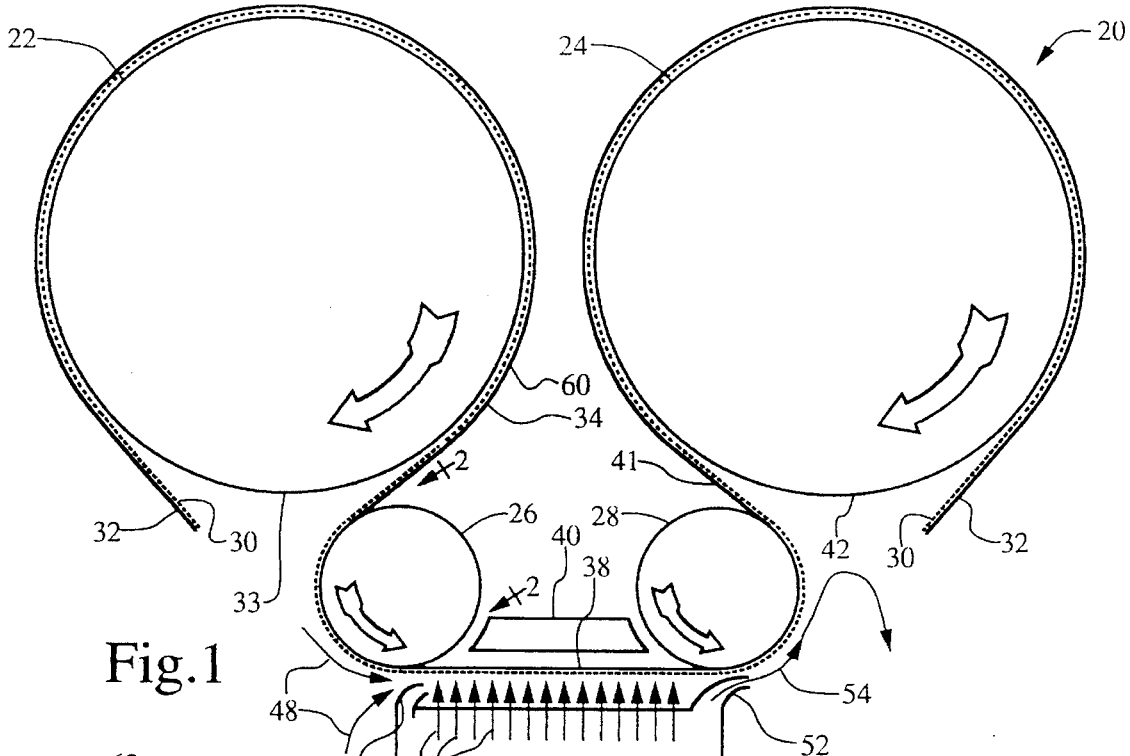
FIG. 1 is a somewhat schematic cross-sectional view of the dryer section of this invention.
Figure 2:
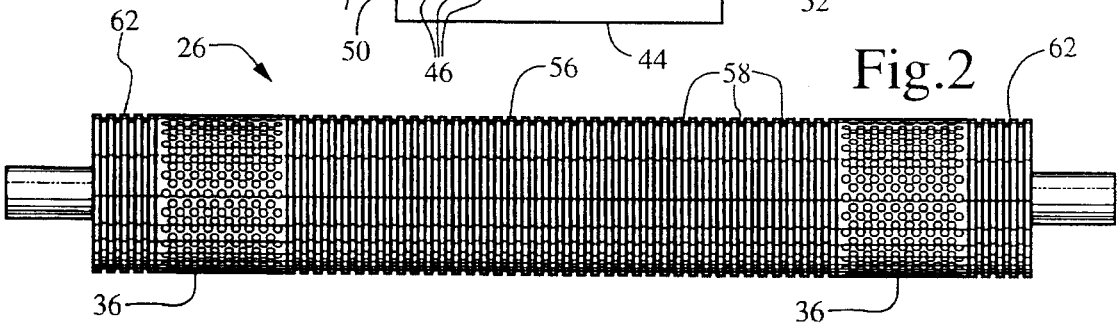
FIG. 2 is a rear elevational view of the reversing roll of FIG. 1 taken along section lines 2—2.
Figure 3:
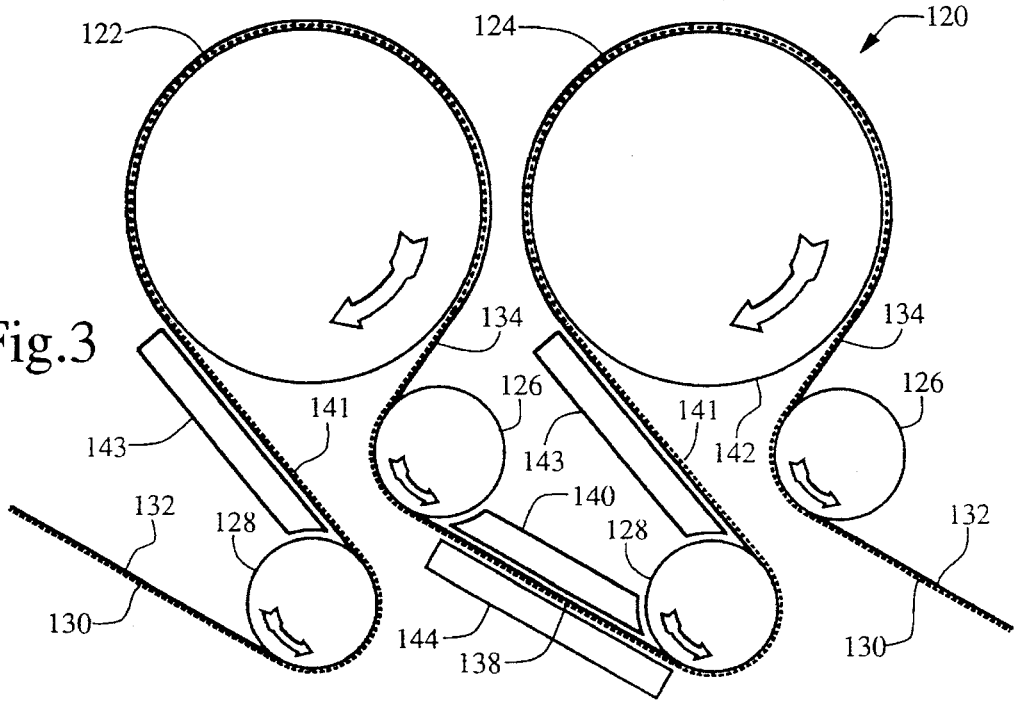
FIG. 3 is a somewhat schematic cross-sectional view of an alternative embodiment dryer section of this invention.

Referring more particularly to FIGS. 1–3, wherein like numbers refer to similar parts, an improved dryer section 20 is shown in FIG. 1. The dryer section 20 has a first dryer roll 22 and a second dryer roll 24. The dryer rolls 22, 24 are seventy-two inches in diameter and are heated internally by pressurized steam. The dryer rolls 22, 24 are part of a drying section of a papermaking machine which may have twenty or more dryer rolls. Further, depending on the position of the dryer roll, the steam pressure (and so the dryer roll temperature) may increase as the paper progresses from the wet end of the papermaking machine to the take-up roll.

Disposed below and closely spaced from the first dryer roll 22 is a first reversing roll 26. Spaced downstream from the first reversing roll 26 and closely spaced from the second dryer roll 24 is a second reversing roll 28. As shown in FIG. 2, each cylindrical reversing roll 26, 28 has a plurality of openings along the edge periphery which define vacuum sections 36 which engage against and hold by suction the edges of the felt and paper web 30. The central portion 56 of each reversing roll 26, 28 has circumferential grooves 58. The grooves 58 allow the boundary layer of higher pressure air which is carried along the outside 60 of the backing felt 32 to be vented around the roll 26. The venting prevents fluttering and wrinkling of the paper web 30. The grooved edges 62 of the roll 26 extend beyond the roll vacuum sections 32 to extend beyond the edges of the felt 32, which typically extends beyond the edges of the paper web 30.

A paper web 30 is overlain by a felt 32 which supports and wraps the paper web 30 around the first dryer roll 24 and supports the web 30 through a first draw 34. The felt 32 extends from the first dryer roll 22 around the first reversing roll 26 where the roll vacuum sections 36 draw air through the felt 32, thus holding the edges of the paper web 30 against fluttering. The paper web 30, backed by the felt 32, then passes through an extended draw 38, where it is supported by a vacuum box 40. The web 30, backed by the felt 32, then passes over the second reversing roll 28. From the second reversing roll 28, the paper web 30 passes through a third draw 41 between the second reversing roll 28 and the second dryer roll 24. The web 30 backed by the felt 32 is then wrapped onto the surface 42 of the second dryer roll 24. The distance between the first reversing roll and the second reversing roll is greater than the distance between the first dryer roll and the second dryer roll, which results in greater web wrapping onto the dryer rolls.

The vacuum box 40 is positioned above the felt 32 and generally engages the felt. A vacuum is drawn on the vacuum box either through a dedicated vacuum source such as a blower or vacuum pump (not shown) or else a vacuum is supplied through the reversing rolls 26, 28.

In a conventional Bel-Champ single tier dryer system, a single reversing roll is positioned between and beneath two dryer rolls. Two advantages are gained by utilizing two somewhat smaller vacuum rolls spaced apart. The first is that the paper web 30 wraps around a greater portion of the circumferential surfaces 33, 42 of the dryer rolls 22, 24. In a dryer section of the present invention utilizing 24-inch reversing rolls 26, 28 as opposed to a single 32-inch reversing roll in a conventional Bel-Champ dryer, the dryer wrap may be increased approximately twenty-one percent. Increased dryer wrap translates into greater dwell time on each dryer roll thus providing greater heat transfer between the web 30 and the dryer rolls 22, 24. Because each dryer roll provides more drying surface, fewer dryer rolls 22, 24 are required for a given papermaking machine, thus saving on the capital cost of the dryer section and on the plant space necessary to house them.

The second advantage provided by the dryer section 22 of this invention is the provision of an extended draw 38 between the vacuum reversing rolls 26, 28 which allows the use of an extended air cap 44, as shown in FIG. 1. The air cap 44 blows hot gasses, shown by arrows 46, which impinge on the web 30, heating and drying it. The air used in the air cap will normally constitute a mixture of air and combustion gasses with a temperature range of between two-hundred and one thousand degrees Fahrenheit. A typical value is five-hundred degrees Fahrenheit. The temperature of the air blown from the air cap 44 can be hotter in the first portion of a dryer section where the paper is wetter, and thus less prone to scorching. In the latter dryer sections, the air from the air cap must be cooler to prevent the nearly dry paper from scorching or catching fire. Typically, the air cap discharges gases on to the web at a velocity of five thousand to thirty thousand feet per minute.

In FIG. 1, arrows 48 show how the air cap 44 may be configured with a curved leading lip 50 to aspirate air from the boundary layer carried along with the web 30. The air cap 44 may also advantageously terminate with an air nozzle 52 so that heated gasses, shown by arrow 54, will continue to dry the paper web 30 as it proceeds around the second reversing roll 28. The felt 32 will advantageously be foraminous in character, typically having a permeability of ninety cubic feet per minute per square foot. It should also be understood that felt 32 may be replaced by a screen or similar foraminous support.

An alternative paper drying section 120 of the invention is shown in FIG. 3. The dryer section 120 has a first dryer roll 122 and a second dryer roll 124. The dryer rolls 122, 124 are heated internally by pressurized steam. The dryer rolls 122, 124 are part of a drying section 120 of a papermaking machine which may have twenty or more dryer rolls. Disposed below and adjacent to the first dryer roll is a first reversing roll 126. Spaced apart from the first reversing roll 126 and spaced below and beneath the second dryer roll 124 is a second reversing roll 128. The reversing rolls 126, 128 have the structure of the reversing roll 26, shown in FIG. 2. A paper web 130 is overlain by a felt 132 which supports and wraps the paper web 130 around the first dryer roll 122 and supports the web 130 through a first draw 134. The felt 132 is then wrapped around the first reversing roll 126 where the vacuum sections of the reversing roll draw air through the felt 132, thus holding the edges of the paper web 130 against fluttering. The paper web 130, backed by the felt 132, then passes through an extended draw 138, where it is supported by a vacuum box 140. The web 130, backed by the felt 132, then passes around the second reversing roll 128. From the second reversing roll 128, the paper web 30 passes through a third extended draw 141 between the second reversing roll 128 and the second dryer roll 124. The web 130 backed by the felt 132 is then wrapped onto the surface 142 of the second dryer roll 124. The dryer section 120 achieves increased drying of the paper web 130 by increasing the length of the third draw 141 by moving the second reversing roll 128 downwardly and beneath the second dryer roll 124.

This positioning of the second reversing roll 128 also increases the length of the extended draw 138 between the first reversing roll 126 and the second reversing roll 128. The extension of the third draw 141 requires the addition of a second vacuum box 143 to support the web of the third draw 141. By moving the second reversing roll 128 downwardly, additional drying takes place during the third draw 141 and while the web 130 passes beneath the extended air cap 144.

In this way, without extending the length of the dryer, the amount of drying per dryer section is increased, allowing a dryer section even shorter than the dryer section 20. Reduction in dryer section length saves both capital cost and plant cost.

It should be understood that the diameter of the dryer rolls may be varied. Further the diameter of the reversing rolls may be varied. Additionally, although the reversing rolls have been illustrated as grooved vacuum rolls, the dryer apparatus may also employ blind-drilled rolls, fully drilled vacuum rolls, plain rolls, or a combination of roll types. In addition, if desired a grooved vacuum roll may be utilized without a source of vacuum connected to the rolls, relying instead on the vacuum drawn through the vacuum box.

It should also be understood that some of the advantageous effects of the dryer section 20 can be achieved without the air cap 44.

It should also be understood that the dryer section 20 can be employed with paper machines having dryer sections of varying lengths. Furthermore, where a felt has been indicated, it should be understood that a conventional dryer wire or other type supporting web may be employed.

It should also be understood that the invention is not confined to the particular construction and arrangement of parts herein illustrated and described, but embraces such modified forms thereof as come within the scope of the following claims.

We claim:

1. A dryer for a paper web as part of a paper manufacturing process, comprising:

a first rotatable heated cylindrical dryer roll;

a second rotatable heated cylindrical dryer roll spaced from the first dryer roll;

a first reversing roll rotatably mounted after the first dryer roll;

a second reversing roll rotatably mounted after the first reversing roll and before the second dryer roll;

a supporting web which overlies the paper web, wherein the paper web and supporting web extend over the first dryer roll to the first reversing roll, and from the first reversing roll to the second reversing roll, and from the second reversing roll to the second dryer roll, and wherein the second reversing roll is spaced from the first reversing roll to define an extended draw of paper web and supporting web therebetween; and a vacuum box positioned between the first reversing roll and the second reversing roll and in supporting engagement with the supporting web in the draw defined therebetween.

2. The apparatus of claim 1 wherein the supporting web engages the reversing rolls and is positioned between the reversing rolls and the paper web in the draw, and wherein the vacuum box is positioned above the supporting web in the draw.

3. The apparatus of claim 2 further comprising an air cap positioned below the paper web as it passes between the first reversing roll and the second reversing roll, wherein the air cap is opposed to the vacuum box, and wherein the air cap directs heated gases on to the web while it is restrained by the vacuum box.

4. The apparatus of claim 3 wherein the air cap discharges gases on to the web at a velocity of between five thousand and thirty thousand feet per minute and at a temperature of between two hundred and one thousand degrees Fahrenheit.

5. The apparatus of claim 1 wherein the second reversing roll is positioned below the second dryer roll to define a second draw of supporting web and paper web which extends therebetween, and further comprising a second vacuum box positioned to overlie the supporting web as it extends through the second draw and to retain the supporting web through the second draw.

6. The apparatus of claim 1 wherein the first reversing roll and the second reversing roll each have ends which are adjacent edges of the supporting web, and wherein air is drawn through portions of the ends to prevent flutter of the supporting web edges.

7. The apparatus of claim 6 wherein the first reversing roll and the second reversing roll are cylindrical and have portions defining a plurality of circumferential grooves through which gases may pass beneath the supporting web.

8. The apparatus of claim 1 wherein the distance between the first reversing roll and the second reversing roll is greater than the distance between the first dryer roll and the second dryer roll.

9. The apparatus of claim 1 wherein the first reversing roll is positioned with respect to the first dryer roll to cause at least 270 degrees of the first dryer roll circumference to be wrapped with the paper web.

10. The apparatus of claim 1 wherein the first reversing roll is positioned with respect to the first dryer roll to cause greater than 225 degrees of the first dryer roll circumference to be wrapped with the paper web.

11. A dryer section for drying a web comprising:

a first rotatable heated cylindrical dryer roll;

a second rotatable heated cylindrical dryer roll spaced from the first dryer roll;

a first reversing roll rotatably mounted after the first dryer roll;

a second reversing roll rotatably mounted after the first reversing roll and before the second dryer roll;

a felt which supports the paper web, wherein the paper web is engaged with the first dryer roll and backed by the felt, and wherein the paper web and felt extend from the first dryer roll to the first reversing roll, and wherein the felt is engaged with the first dryer roll and backed by the paper web, and wherein the paper web and felt extend from the first reversing roll to the second reversing roll, and from the second reversing roll to the second dryer roll, and wherein the second reversing roll is spaced from the first reversing roll to define a draw of paper web and felt therebetween; and a vacuum box positioned between the first reversing roll and the second reversing roll to overlie the felt in the first draw, wherein air is drawn through the vacuum box to retain the felt and paper web in engagement therewith through the first draw.

12. The apparatus of claim 11 further comprising an apparatus which blows heated air onto the paper web as it passes between the first reversing roll and second reversing roll.

13. The apparatus of claim 12 wherein the blowing apparatus discharges gases on to the web at a velocity of between five thousand and thirty thousand feet per minute and at a temperature of between two hundred and one thousand degrees Fahrenheit.

14. The apparatus of claim 11 wherein the first reversing roll and the second reversing roll each have ends which are adjacent edges of the felt, and wherein at least one of said ends defines portions through which air is drawn to prevent flutter of the supporting web edges and to draw air through the vacuum box.

15. The apparatus of claim 11 wherein air is drawn through the vacuum box by a vacuum source.

16. The apparatus of claim 11 wherein the first reversing roll and the second reversing roll are cylindrical and have portions defining a plurality of circumferential grooves through which gases may pass beneath the felt.

17. The apparatus of claim 11 wherein the second reversing roll is positioned below the second dryer roll to define a second draw of felt and paper web which extends therebetween, and further comprising a second vacuum box positioned to overlie the felt as it extends through the second draw and to retain the felt through the second draw.

18. The apparatus of claim 11 wherein the distance between the first reversing roll and the second reversing roll is greater than the distance between the first dryer roll and the second dryer roll.

19. The apparatus of claim 11 wherein the first reversing roll is positioned with respect to the first dryer roll to cause at least 270 degrees of the first dryer roll circumference to be wrapped with the paper web.

20. The apparatus of claim 1 wherein the first reversing roll is positioned with respect to the first dryer roll to cause greater than 225 degrees of the first dryer roll circumference to be wrapped with the paper web.

21. The apparatus of claim 11 wherein the air is drawn through the vacuum box through at least one of the first and second reversing rolls.

* * * * *

UNITED STATES PATENT AND TRADEMARK OFFICE

CERTIFICATE OF CORRECTION

PATENT NO. : 5,522,151

DATED : 06/04/96

INVENTOR(S) : Deshpande et al

It is certified that error appears in the above-indentified patent and that said Letters Patent is hereby corrected as shown below:

Column 3, line 21: "22" should read --24--.

Column 3, line 39: "22" should read --24--.

Signed and Sealed this

Twenty-fifth Day of March, 1997

*Attest:*

Bruce Lehman

BRUCE LEHMAN

*Attesting Officer*

*Commissioner of Patents and Trademarks*